US009879418B2

(12) United States Patent
Östlund et al.

(10) Patent No.: US 9,879,418 B2
(45) Date of Patent: Jan. 30, 2018

(54) WALL ELEMENT, WALL SECTION COMPRISING SAID WALL ELEMENT AND A METHOD FOR BUILDING SAID WALL SECTION

(71) Applicant: Paralox AB, Sundsvall (SE)

(72) Inventors: Martin Östlund, Söråker (SE); Joakim Moxén, Söråker (SE)

(73) Assignee: Paralox AB, Sundsvall (SE)

( * ) Notice: Subject to any disclaimer, the term of this patent is extended or adjusted under 35 U.S.C. 154(b) by 0 days.

(21) Appl. No.: 15/516,328

(22) PCT Filed: Oct. 2, 2015

(86) PCT No.: PCT/SE2015/051039

§ 371 (c)(1),
(2) Date: Mar. 31, 2017

(87) PCT Pub. No.: WO2016/053177

PCT Pub. Date: Apr. 7, 2016

(65) Prior Publication Data

US 2017/0306619 A1 Oct. 26, 2017

(30) Foreign Application Priority Data

Oct. 2, 2014 (SE) ..... 1451170

(51) Int. Cl.
*E04B 2/02* (2006.01)
*E04B 2/78* (2006.01)
(Continued)

(52) U.S. Cl.
CPC ..... *E04B 2/02* (2013.01); *E04B 1/02* (2013.01); *E04B 1/6125* (2013.01);
(Continued)

(58) Field of Classification Search
CPC .... E04B 1/6125; E04B 1/6137; E04B 1/6141; E04B 1/6158; E04B 1/12; E04B 1/14;
(Continued)

(56) References Cited

U.S. PATENT DOCUMENTS 2,107,418 A * 2/1938 Keller ..... E04B 1/6145 52/586.2
2,629,138 A * 2/1953 Hultquist ..... E04B 1/02 52/745.13

(Continued)

FOREIGN PATENT DOCUMENTS

CA 2897479 A1 7/2014
DE 3441837 A1 * 5/1986 ..... E04B 1/14

(Continued)

OTHER PUBLICATIONS

International Search Report, Corresponding International Application No. PCT/SE2015/051039 dated Dec. 15, 2015, 4 pages.

*Primary Examiner* — Adriana Figueroa
*Assistant Examiner* — Jessie T Fonseca
(74) *Attorney, Agent, or Firm* — Cooper Legal Group LLC

(57) ABSTRACT

The present invention relates to a wall element comprising an upper element extending along an upper edge, a lower element extending along a lower edge, a first and second side element each comprising a substantially rectangular cross section, the first side element extending along a first side between the upper and lower element, the second side element extending along a second side between the upper and lower element and a substantially rectangular board arranged on an outer side and attached to said the upper element, lower element and first side element. The upper and lower element comprise a first edge coinciding with the first side and a second edge coinciding with the second side, wherein the first and second edge are arranged in an angle (Continued)

with respect to a plane perpendicular to the outer side, and the first and second side elements extending parallel to the plane, perpendicular to the board and having a total extension in the plane corresponding to the extension of the upper and lower element in the plane, wherein the first side element bears against the board and the second side element extends from the inside of the wall element. The invention further relates to a wall section comprising the wall element and a method for building the wall section.

14 Claims, 4 Drawing Sheets

(51) Int. Cl.

| | |
|---|---|
| ***E04C 2/30*** | (2006.01) |
| ***E04C 2/38*** | (2006.01) |
| ***E04C 2/284*** | (2006.01) |
| ***E04B 1/02*** | (2006.01) |
| ***E04B 1/61*** | (2006.01) |
| *E04C 2/00* | (2006.01) |
| *E04B 1/32* | (2006.01) |

(52) U.S. Cl.
CPC ..... *E04B 2/7818* (2013.01); *E04C 2/284* (2013.01); *E04C 2/30* (2013.01); *E04C 2/386* (2013.01); *E04C 2/388* (2013.01); *E04B 2001/3288* (2013.01); *E04C 2002/004* (2013.01); *E04F 2201/023* (2013.01)

(58) Field of Classification Search
CPC ..... E04B 1/02; E04B 2001/3276; E04B 2001/3288; E04B 2/02; E04B 2/7818; E04F 2201/02; E04F 2201/023; E04C 2/388; E04C 2/386; E04C 2/284; E04C 2/30; E04C 2002/004
See application file for complete search history.

(56) References Cited

U.S. PATENT DOCUMENTS

| | | | | | |
|---|---|---|---|---|---|
| 4,281,495 | A * | 8/1981 | Lee | E04C 2/386 | 52/127.12 |
| 5,067,296 | A * | 11/1991 | Brown | E04C 2/386 | 52/295 |
| 5,743,056 | A * | 4/1998 | Balla-Goddard | E04B 1/14 | 52/127.9 |
| 5,842,276 | A * | 12/1998 | Asher | B26D 1/553 | 264/142 |
| 7,549,263 | B1 * | 6/2009 | Porter | E04B 1/14 | 52/127.7 |
| 2010/0005746 | A1 * | 1/2010 | Lemay | E04C 2/296 | 52/506.05 |
| 2011/0047912 | A1 * | 3/2011 | Armijo | E04B 1/12 | 52/309.4 |

FOREIGN PATENT DOCUMENTS

| | | | | |
|---|---|---|---|---|
| FR | 2982626 | A1 * | 5/2013 | E04C 2/26 |
| GB | 1361805 | A | 7/1974 | |
| GB | 2500097 | A | 9/2013 | |
| WO | 9534723 | A1 | 12/1995 | |
| WO | 2007088239 | A1 | 8/2007 | |

* cited by examiner

WALL ELEMENT, WALL SECTION COMPRISING SAID WALL ELEMENT AND A METHOD FOR BUILDING SAID WALL SECTION

TECHNICAL FIELD

The present invention relates to a wall element, a wall section comprising said wall element and a method for building said wall section.

BACKGROUND

Different types and sizes of houses and buildings have since long been used for different purposes such as for housing, commercial properties and storage.

Said houses and buildings may be built using different materials depending on availability of materials in different geographical areas. In Sweden and in many other countries where forests are abundant many houses are built using different kinds of wooden frameworks covered by suitable facing materials and insulated in order to reduce energy consumption related to heating of the building. These buildings are either built according to the principle of loose timber houses, which implies that one or more builders build the wooden frame work using timber of suitable dimensions, which frame is thereafter covered by a desired inner and outer covering and an intermediate insulation, or prefabricated elements which are manufactured in one location and transported to the site of the building where large sections are lifted into place onto a previously prepared ground structure, or foundation, for example a concrete slab, by means of a mobile crane or other hoisting crane. Building utilizing the loose timber house method is unfortunately very time consuming which brings that the building during the construction time will be exposed to wind and weather during a very long time which increases the risk of damage due to moist and future problems relating to mould and the like. The method is further expensive. Prefabricated buildings may be quickly lifted into place but require expensive equipment and expensive transportation of the section of the house.

Accordingly, there is a need in the art for a building element and a method facilitating building and reducing the time until the outer surfaces of the building are completed, the building thereby not being damage by external factors such as wind and weather.

SUMMARY OF THE INVENTION

The present invention, as defined by claim 1, relates to a wall element intended to be used for construction of different kinds of buildings.

The wall element according to the invention comprises an upper edge, a lower edge substantially parallel to the upper edge, a first side and a second side, the first and second side being substantially parallel and extending between the upper and lower edge, and an outer side and an inner side. The wall element comprises an upper element extending along the upper edge, a lower element extending along the lower edge, a first side element comprising a substantially rectangular cross section, the side element extending along the first side between the upper and lower element, a second side element comprising a substantially rectangular cross section, the side element extending along the second side between the upper and lower element and a substantially rectangular board arranged on the outer side and attached to the upper element, lower element and first element. The upper and lower elements comprise a first edge coinciding with the first side and a second edge coinciding with the second side. The first and the second edge are arranged in an angle $\alpha$ with respect to a plane P perpendicular to the outer surface, the angle $\alpha$ lies within the interval 20° to 45°. The first and second side elements extend parallel to the plane P, perpendicular to the plate (board) and have a total extension in the plane P corresponding to the extension of the upper and the lower element in the plane P, wherein the first side element bear against the plate and the second side element extend from the inside of the wall element.

The above defined wall element facilitates the construction of different types of buildings considerably since the wall elements may be prefabricated to suitable sizes, for example a height of approximately 2.5 m and a width of 1.2 m, which allows for handling of the elements without lifting aids such as a mobile crane and the like. The number of wall elements is adapted to the desired size of the building and are placed side by side on the prepared foundation such that the first side of one of the wall elements bear against the second side of the other wall element.

The angled edge of the upper and the lower element respectively, combined with the design and the placement of the first and second side elements respectively, greatly facilitates mounting and fixing of the wall element to one another since the angled surfaces guide the wall elements to the desired relative position with respect to one another. When the adjacent wall elements are correctly placed with respect to one another, the first side element of one of the wall elements is arranged in the same plane as the second side element belonging to the other wall element such that they may be easily joined together by means of suitable fastening means extending substantially perpendicular to the board through the first and the second side element. Commonly, the fastening means is inserted from the inside of the wall element.

The combination of the angled edges of the upper and lower element and the first and second side elements eliminates thermal bridges in the wall which is very important in order to reduce the energy consumption of the building and to ensure a pleasant indoor climate in the building.

The shape of the cross section of the first and second side element respectively implies that the side element of adjacent wall elements will fit together and that the first and the second element will extend in the same plane perpendicular to the outside of the wall elements.

In one embodiment said upper element, said lower element and said first and second side element are made from a cellulose based material such as wood or paper. These materials yield a very environmentally friendly wall element which in the future may be recycled. These materials further imply a healthy work environment during manufacturing of the wall element and assembly of the wall section.

In one embodiment, the centre of the first and the second side elements coincides with the centre of the first and the second edge respectively. This embodiment is advantageous since it will yield a very stable connection between adjacent wall elements.

In one embodiment of the wall element, the board is made from an insulating material and has a thickness in the range from 30 mm to 80 mm. Thereby, the façade board is in place when the wall element is mounted and the total time required for erecting the building is reduced.

In one embodiment, the extension of the first side element in the plane perpendicular to the wall element amounts to ⅔ of the extension of the upper and the lower elements in the plane perpendicular to the wall element, and in that the extension of the second side element in the plane perpendicular to the wall element amounts to ⅓ of the extension of the upper and the lower elements in the plane perpendicular to the wall element. The arrangement of the contact surface between the adjacent first and second wall element yield an efficient disruption in a potential thermal bridge in the wall.

One embodiment of the wall element comprise a centre element extending in parallel with respect to said first and second side element and being arranged between the first and second side element. The centre element comprises a length corresponding to said upper and lower element. The centre element improves the stability and torsional rigidity of the wall element which facilitates handling of the wall element and fitting of the wall elements to one another. The vertical load bearing capability of the wall element is also increased.

In one embodiment of the wall element, insulating material is arranged between said side elements in order to reduce the energy consumption of the wall element.

In one embodiment of the wall element, the board arranged on the outside of the wall element extends between the centre of the first and second side element on the outside of the wall element which is very advantageous in that the board on the outside of the wall element may be attached to the load bearing structure close to the edge of the board, by means of a suitable screw joint.

The present invention further relates to a wall section comprising at least two wall elements according to any of the definitions above, arranged such that the boards on the outside of the wall elements are arranged facing the same direction and such that the first edge of one of the wall elements bear against the second edge of the other wall element, wherein the first side element comprised by one of the wall elements and the second side element comprised by the other wall element bear against each other.

One embodiment of the walls section is characterized in that the two wall elements are joined together by means of joining means joining said first side element belonging to one of the wall elements and the second side element belonging to the other wall element substantially parallel to a plane perpendicular to the outside of the wall sections. This joining provides a strong interconnection between the wall elements.

In one embodiment of the invention, the two wall elements are joined by means of screwing means joining said upper and lower element belonging to one of the wall elements and said upper and lower element belonging to the other wall element, said screwing means extending diagonally with respect to a plan P perpendicular to the outside of the wall element. This fastening facilitates positioning of the different comprised wall elements.

The invention further relates to a method for facilitating building of housed and reducing the building time. The method comprises the steps of:

a) arranging the first wall element in a desired location;
b) arranging the second wall element such that the plates on the outside of the wall elements are facing the same direction, and such that the first edge of the first wall element bears against the first edge of the second wall element, wherein the first side element belonging to the first wall element and the second side element belonging to the second wall element bear against one another;
c) fastening the two wall elements to one another In one embodiment, step c, comprises fastening of the wall elements by means of fastening means joining said first side element belonging to one of the wall elements and said second side element belonging to the other wall element substantially parallel to a plane P perpendicular to the outside of the wall elements.

In one embodiment, step c comprises fastening of the wall elements by means of screwing means joining said first side element belonging to one of the wall element and the second side element belonging to the other wall element, said screwing means extending diagonally to a plane P perpendicular to the outside of the wall elements.

BRIEF DESCRIPTION OF THE DRAWING

The information furnished above, as well as further objects, features and advantages of the present invention will be better understood through the following illustrative and non-limiting detailed description of preferred embodiments of the present invention, with reference to the appended drawing, on which.

Figure 1A:
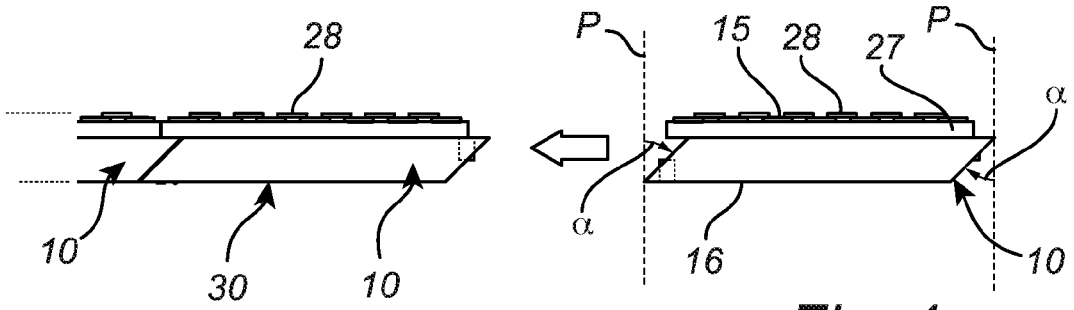
FIG. 1*a* shows a wall section wherein two wall elements are joined together and a third wall element is about to be mounted, viewed from above or below.
Figure 1B:
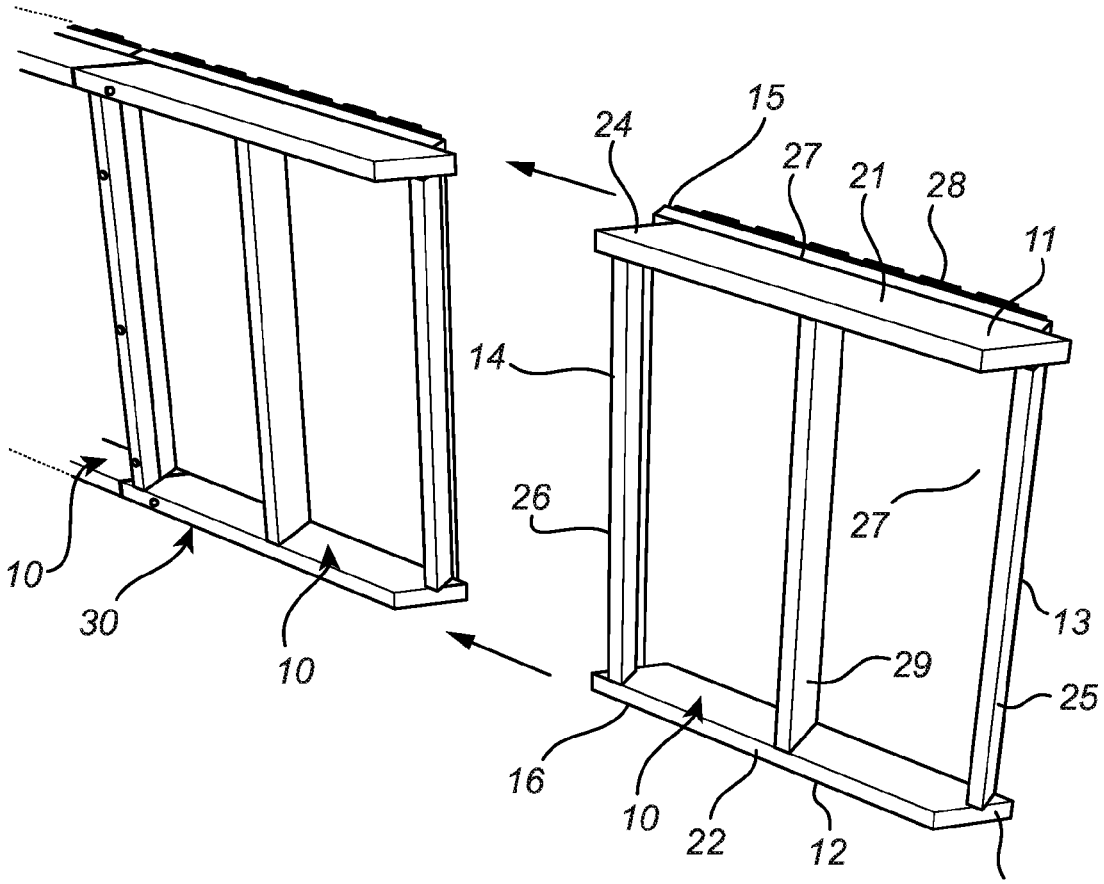
FIG. 1*b* is a perspective view of the wall section of FIG. 1*a;*

All figures are schematic, not necessarily to scale, and generally only show parts which are necessary in order to elucidate the invention, wherein other parts may be omitted or merely suggested.

DETAILED DESCRIPTION OF EMBODIMENTS

The present invention as previously indicated relates to a wall element 10 which by means of its design may be joined together with other wall elements 10 identical in design to form an elongated wall section 30.

Commonly, the wall elements 10 are substantially rectangular flat elements which are vertically arranged on a stable ground such as a moulded foundation plate. The wall elements may however also be produced to a curved or angled shape.

The wall elements 10 comprise an upper edge 11 and a lower edge 12, which edges are substantially parallel and, when the wall element is correctly mounted, arranged substantially horizontal. A first edge 13 and a second edge 14 extend vertically substantially parallel between the upper edge 11 and the lower edge 12, and substantially perpendicular between the upper 11 and the lower edge 12. After assembly, one side of the wall element 10 will form an outside, or outer, side of the wall section and the opposite side will form an inside, or inner, side 16.

A first embodiment of the wall element 10 comprises the various elements specified and described below.

A lower elongated element 21 extends along said upper edge 11 of the wall element 10. The upper element 21, in the art known as a top plate, has a rectangular cross section and is arranged in a lying position such that the extension in a horizontal direction is larger than the extension in a vertical direction. After assembly, the upper element 21 supports a roof structure which is placed on top of the wall element 10 or alternatively one, or more, wall elements 10 to reach a desired higher total wall height.

A lower elongated element 22 extends along said lower edge 12 of the wall element 10. The lower element, in the art known as a sill, has a rectangular cross section having the same dimensions as the upper element 21 and is arranged such that the extension in a horizontal direction is larger than the extension in a vertical direction similarly to the upper element 21. The lower element is likewise arranged in a lying position and bears onto the foundation plate after assembly, alternatively onto the upper side of an underlying layer of wall elements. Commonly, some kind of capillary breaking layer is arranged between the lower element and the plate in order to avoid damage due to damp. This is not shown in the drawing.

The upper element 21 and the lower element 22 comprise a first edge 23 arranged in connection with the first side 123 of the wall element 10 and a second edge 24 arranged in connection to the second side 14 of the wall element. The first 23 and the second edge 24 are angled at an angle $\alpha$ with respect to a plane P perpendicular to said outer side 15, shown in FIG. 1*a*. The first edge 23 and the second edge 24 are commonly arranged at the same angle $\alpha$ with respect to the plane of the wall element. The angle $\alpha$ commonly lies in the range between 20° to 45°, since angles in this interval facilitates assembly of adjacent wall elements. A to large angle gives rise to an increased friction between contact surfaces, i.e. the edges of adjacent wall elements, due to an increase of the area of the contact surfaces which in turn complicates mounting. Further, by means of the angled first 23 and second edge 24 of the wall elements, so called thermal bridges in the wall section are avoided which reduces the energy consumption of the building and improves the indoor climate. Preferably, the angle $\alpha$ is between 25° and 35°, these angles yield an effective assembly and a stable wall section when the adjacent wall elements are joined together.

A first side element 15 extends along said first side 13 of the wall element 10 between said upper element 21 and lower element 22. The first side element 25, in the art known as a stud, has a substantially rectangular cross section and is firmly attached to the upper 21 and lower element 22 at its ends. The first side element has a smaller extension in the plane P perpendicular to the wall element than said upper 21 and lower element 22 and is arranged to extend from the outside 15 of the upper 21 and lower element 22 perpendicular with respect to said outside 15.

A second side element 26, likewise comprising a substantially rectangular cross section extends between the upper 21 and the lower element 22 along the second side 14 of the wall element 10. The side element 26 is attached to the upper 21 and lower element 22, but is unlike the first side element 25 arranged to extend perpendicular towards the outside of the wall element 10 from the inside of the wall element, i.e. the inner edge of the upper 21 and lower element 22.

The placement of the first 25 and second 26 side elements is chosen such that when two wall element 10 according to the invention are correctly mounted next to one another the first side element 25 of one of the wall elements 10 is arranged substantially in the same plane as the second side element 26 of the other wall element 10. The dimensions of the first 25 and second side elements 26 are such that they have substantially the same extension in the plane of the wall element, and a total extension in a plane perpendicular to the plane of the wall element corresponding to the extension of the upper 21 and lower 22 wall element in the plane perpendicular to the wall element.

The first 25 and the second side element 26 respectively are arranged along the sides 13, 14 of the wall element such that the centre of the contact surfaces of the first 25 and the second 26 side elements coincide when adjacent wall elements 10 are correctly arranged with respect to one another.

The arrangement placement of the first 25 and the second side element 26 respectively is further chosen such that one portion, one corner, of the side element extends beyond the diagonal edge 21 of the upper 21 and lower 22 element, thereby facilitating the positioning of the wall element with respect to one another during assembly. Further, the diagonal edges 23, 34 of the upper and lower elements 21, 22 cross the centre of the joined first and second side element 25, 26. This arrangement, for most dimensions of wall elements, implies that the first and the second side element will be placed slightly retracted from the corner of the upper and lower element between the inside and the angled edge or the outside and the angled edge.

The load bearing structure of the wall element, i.e. the upper 21 and the lower element 22 and the side elements 25, 26 are covered on the outside by a board 27, a so called front board, which is attached to said upper element 21, lower element 22 and first element 25. The board 27 is made from a suitable insulating material and has a thickness in the range between 30-80 mm. On the outside of the board, the wall element 27 may be covered by any desired facade material 28, for example a wood panelling which is attached to the load bearing structure of the wall element. If required, the load bearing structure may be supplemented by horizontal frame work for mounting the front panel.

The dimensions of the board 27 are chosen such that the board extends between the centres of the first 25 and the second board 26. This dimension is very advantageous in that the board 27 will protrude and overlap the first side element 25 of the adjacent wall element 10 along the second side 14 of the wall element. The board 27 may thereby also be anchored to the second wall element 10, thereby increasing stability of the assembled wall section and preventing formation of thermal bridges in the wall.

In a preferred embodiment of the wall element 10, approximately ⅔ of the width of the upper 21 and lower element 22 makes up the extension of the first side element 25 in the plane perpendicular to the wall element, and the extension of the second side element 26 in the plane perpendicular to the wall element amounts to ⅓ of the width of the upper 21 and lower element 22. This ratio yields an advantageous temperature gradient in the wall.

If the horizontal length of the wall element 10 exceeds 60 cm further reinforcement of the wall element is required. The additional reinforcement is suitably achieved by providing the wall element with one, or a plurality of, centre element(s) 29, also known as cross bars, arranged between the first 25 and second element 26 and extending parallel to said first 25 and second element 26 and. The centre element 29 extend between the upper 21 and the lower element 22 and has an extension in the plane perpendicular to the wall element corresponding to the upper 21 and the lower element 22. The centre element 29, or the centre elements, increase the load bearing capacity of the wall element and the stability during transport and assembly.

One advantageous embodiment of the wall element further comprises insulation arranged between the first and the second side element, alternatively the centre element. The thickness of the insulation is suitably between 17-220 mm depending on the desired level of insulation. Further, the thickness of the insulation shall correspond to the extension of the upper 21 and lower 22 elements in the plane perpendicular to the wall element for the best possible insulating effect.

As stated above two or more wall elements 10 are joined together to form a longer wall section 30. The wall elements 10 are arranged such that the boards 27 on the outside of the wall elements face the same direction and the first edge 13 of one of the wall element bear against the second edge 14 of the other wall element 10 such that the first side element 25 belonging to one of the wall elements and the second side element 26 belonging to the other wall element bear against one another.

When adjacent wall elements 10 are correctly arranged relative to each other, the two wall elements 10 are joined together by means of fastening means 31, for example screws or nails, extending through said first side element 25 belonging to one wall element 10 and the second wall element 26 belonging to the second wall element 10 substantially parallel to the plane perpendicular to the outside of the wall elements. The fastening means are usually inserted from the inside of the wall elements.

Figure 2A:
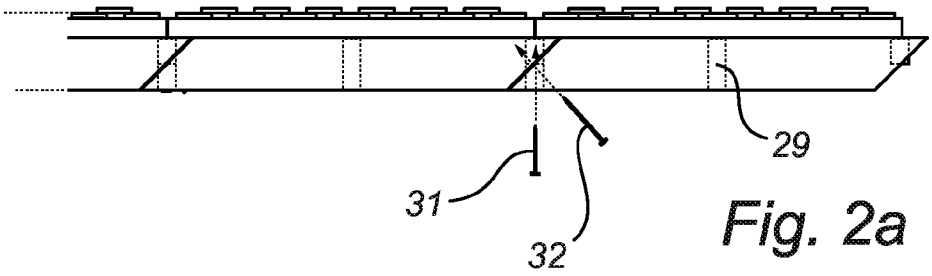
FIG. 2*a* shows the assembly of the walls section of FIGS. 1*a* and 1*b;*
Figure 2B:
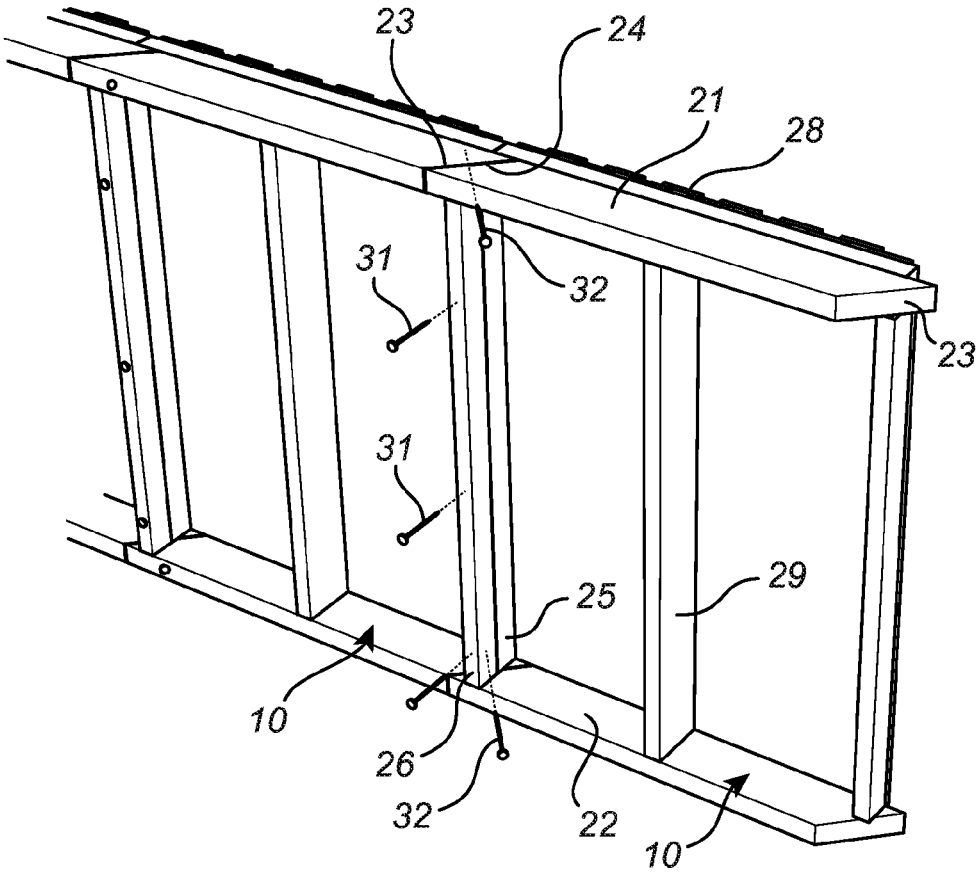
FIG. 2*b*, shows the assembly of the walls section of FIGS. 1*a* and 1*b* in a perspective view.

In order to further increase the stability of the wall section the wall elements are also joined together by means of screw means 32 extending through said upper 21 and lower element 22 belonging to one of the wall elements 10 and said upper 21 and lower element 22 belonging to the other wall element 10. Accordingly, the screwing means 32 extend diagonally with respect to the place perpendicular to the outside of the wall section, as shown in FIGS. 2*a* and 2*b*.

The invention as defined in the present specification also relates to a method for building said wall section 30 described above. The method comprises the steps of:

1. placing the first wall element 10 in a desired location on the prepared foundation;
2. placing the second wall element 10 such that the boards 27 on the outside of the wall elements are facing the same direction, and such that the first edge 13 of the first wall element bears against the second edge 14 of the second wall element 10, wherein the first side element 25 belonging to the first wall element 10 and the second side element 26 belonging to the second wall element 10 bear against one another;
3. fastening the two wall elements 10 to one another When a plurality of wall elements 10 is to be joined together steps 2 and 3 are repeated until the wall section 30 reaches the desired length.

The wall elements may also be designed comprising opening for windows and doors. Depending on the size and placement of the openings, the wall element may be suitably adapted. For example by placing the window opening between side elements such that the side elements are not affected by the opening and by providing suitable reinforcements around the opening, for example centre element arrange on either side of the opening such that the elements may support a window or a door arranged in the opening and possibly cross elements extending between the centre elements and/or the side elements above and/or below the opening.

After assembly is finished, the wall section may be supplemented by an inner structural wall comprising inner wall elements. This inner wall element may accommodate pipes for electrical wiring and the like and may likewise be pre-fabricated ad delivered in completed sections to the construction site.

Figure 3A:
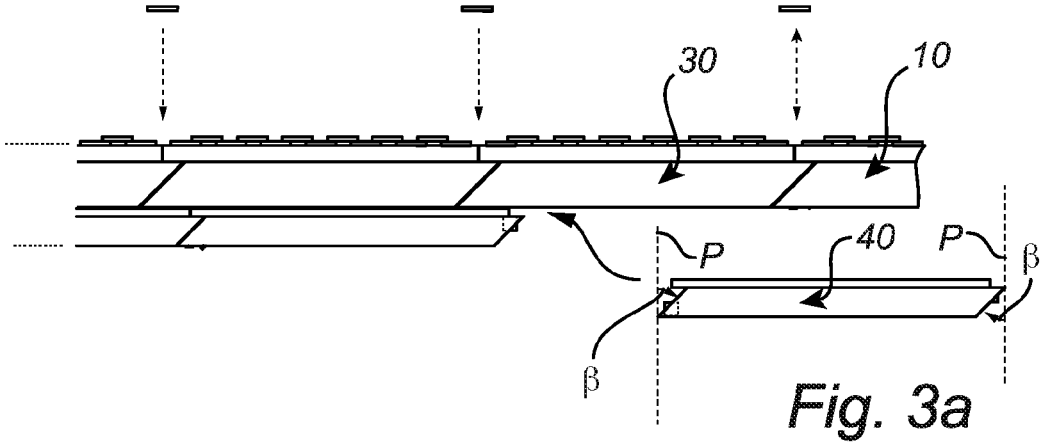
FIGS. 3*a* and 3*b* show the wall section of FIGS. 1 and 2 provided with an inner structural wall.
Figure 3B:
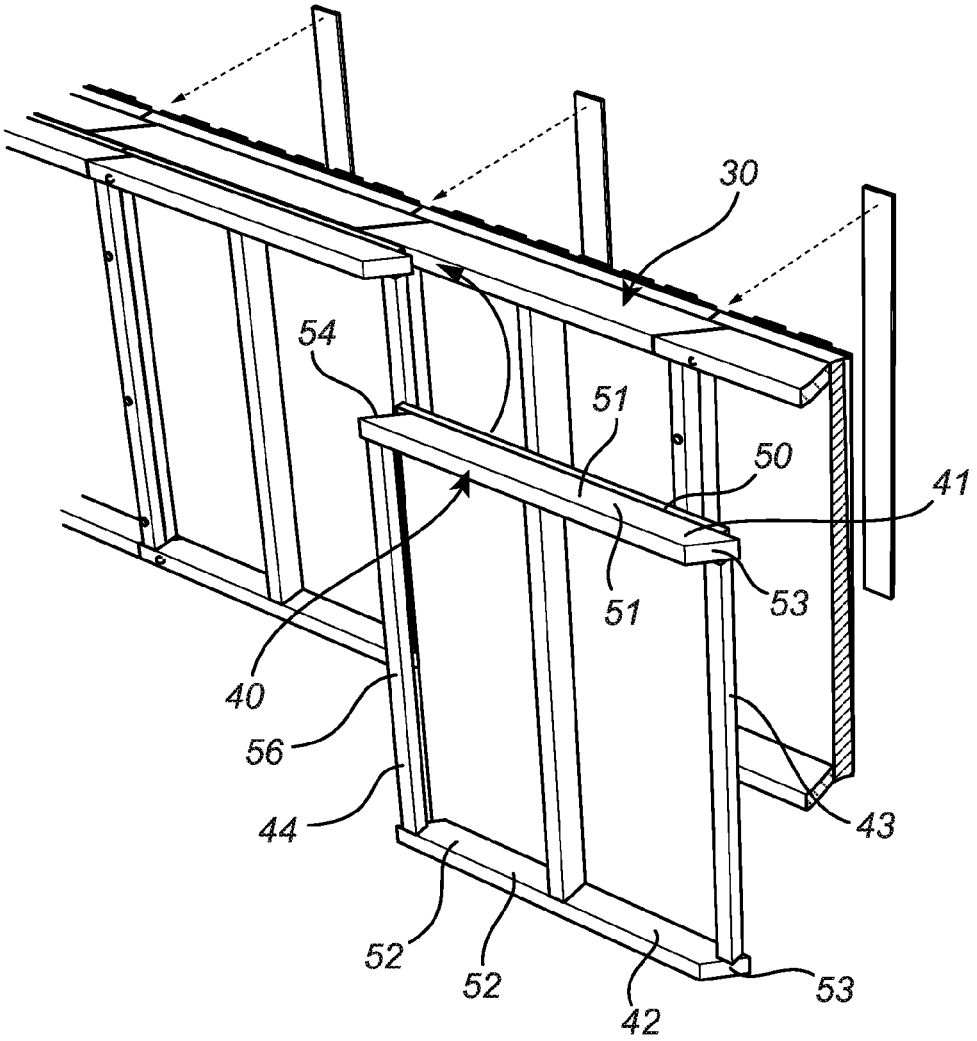
Figure 4:
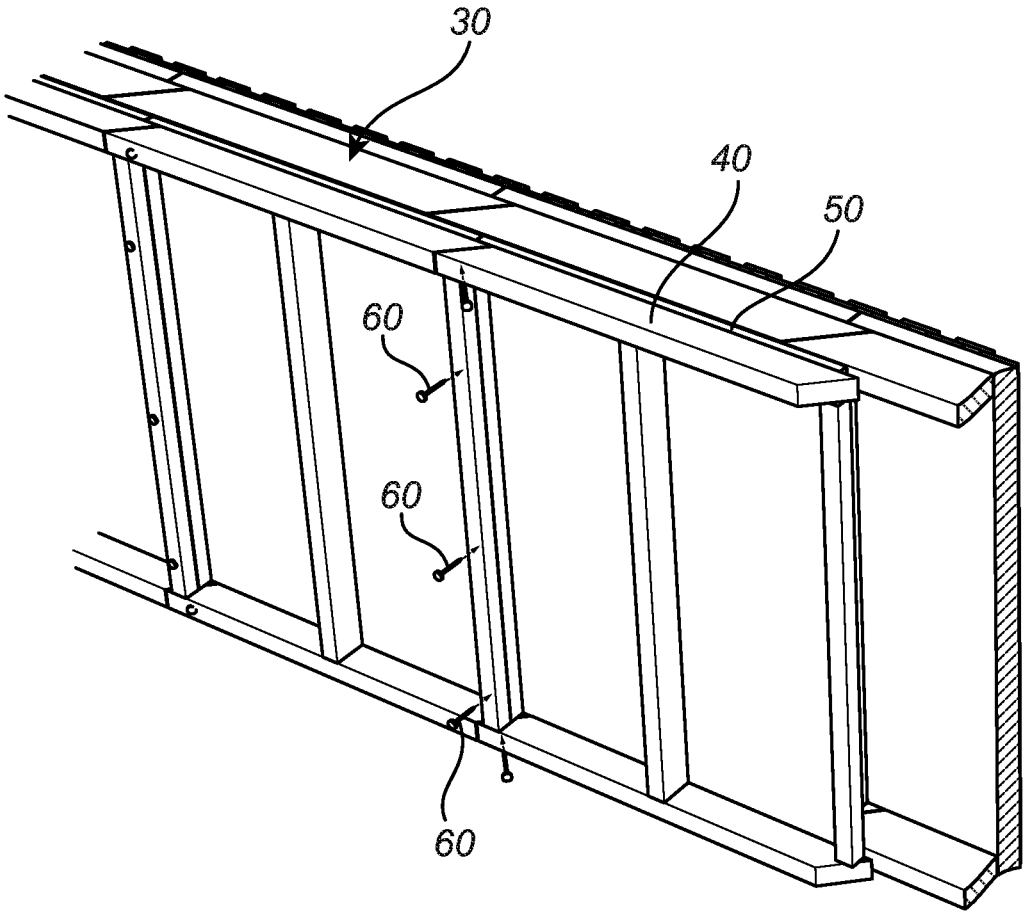
FIG. 4 shows the fixation of the structural wall to the wall section.

The inner wall element 40 of the structural wall has a similar design as the wall element described in detail above and is shown in FIGS. 3*a*, 3*b*, and 4. The structural wall has the same height as the wall section 30 and suitably a similar width such that the number of element of the wall section 30 and the structural wall is similar.

The inner wall element 40 comprises an upper edge 41 and a lower edge 42, which are substantially parallel. A first 43 and a second side 44 extend vertically substantially parallel between the upper edge 41 and the lower edge 42, and perpendicular between the upper 11 and lower edge 12. After assembly, one of the sides of the inner wall element will bear against the inner side of the wall section 30.

The structural wall comprises a load bearing structure comprising an upper crossbar 51 and a lower crossbar 52 which after assembly are arranged substantially horizontal along the upper and lower element of the wall section. After assembly, the lower cross bar 52 will bear against the foundation plate, alternatively against the upper side of an underlying layer of wall elements.

The upper 51 and lower cross bar 52, similarly to the wall element 10, comprise a first edge 53 arranged in connection with the first side 53 of the inner wall element 40 and a second edge 54 arranged in connection with the second side 54. The first 53 and the second edge 54 are, as described above, angled at an angle β with respect to a plane P perpendicular to the plane of the wall element. The angle β commonly lies in the interval between 20° to 45° since angles within this interval facilitates mounting of adjacent inner wall elements by analogy with what has been described above. Preferably the angle β is between 25° to 35° since these angles yields an effective assembly and a stable structural wall.

A first 55 and a second 56 side piece extend between the upper and lower cross bar on the respective sides of the inner wall section. The side pieces 55 and 56 have a smaller extension perpendicular to the inner wall element by analogy with what has been described above with reference to the wall element 10, such that the first side piece of one inner wall element corresponds to the second side piece of adjacent inner wall elements. The placement of the first and the second side piece is chosen such that when two inner wall elements 40 according to the invention are mounted correctly next to one another, the first side piece 55 of one of the wall element will be arranged in substantially the same plane as the second side piece of the second inner wall element. The dimensions of the first 55 and the second 56 side elements are such that they have substantially the same extension in the plane of the inner wall element and a total extension in a plane perpendicular to the extension in a plane perpendicular to the plane of the inner wall element corresponding to the extension of the upper 51 and the lower cross bar 52. The side pieces are arranged along the sides of the inner wall element, in such a way that the centre of the contact surfaces of the side pieces coincide when adjacent inners wall elements are correctly placed with respect to one another along the inner side of the wall section, wherein the inner wall elements are joined together by means of suitable screws 60 or nail joints in the same way as in the wall section 30.

A plastic film 50 or another suitable vapour barrier may suitably be arranged between the wall section 30 and the structural wall 40. This plastic film or diffusion barrier may either be attached to the inner wall elements when delivered or be attached to the load bearing structure during assembly.

In order to obtain an effective insulation of the finished wall it is very advantageous if the volume inside the inner wall elements as well is filled with an insulating material before the wall is sealed by means of a suitable wall covering such as plaster or wood panelling. The insulation may be arranged during manufacturing of the wall element or on site when the elements are mounted to the inner side of the wall section.

In the appended drawing one embodiment of the wall element and the wall section according to the claims is illustrated. A plurality of the structural components of the wall element may however be modified in a plurality of ways without departing from the scope of protection of the invention as defined by the appended claims.

The invention claimed is:

1. Wall element comprising an upper edge, a lower edge substantially parallel to said upper edge, a first side and a second side, said first and second side being substantially parallel and extending between said upper and lower edge, and an outer side and an inner side, said wall element comprising:

an upper element extending along said upper edge;

a lower element extending along said lower edge;

a first side element comprising a substantially rectangular cross section, said side element extending along said first side between said upper and lower element;

a second side element comprising a substantially rectangular cross section, said side element extending along said second side between said upper and lower element; and a substantially rectangular board arranged on said outer side and attached to said upper element, lower element and first element; wherein said upper and lower element comprise a first edge coinciding with said first side and a second edge coinciding with said second side, wherein said first and said second edge are arranged in an angle a with respect to a plane P perpendicular to said outer side, wherein said angle a lies within the interval 20° to 45°, and said first and second side elements extending parallel to said plane P, perpendicular to the board and having a total extension in the plane P corresponding to the extension of the upper and the lower element in the plane P, wherein said first side element bears against the board and said second side element extends from the inner side of the wall element.

2. Wall element according to claim 1, characterized in that said upper element, said lower element and said first and second side element are made from a cellulose based material.

3. Wall element according to claim 1, characterized in that a centre of the first and the second side element coincides with a centre of the first and the second edge respectively.

4. Wall element according to claim 1, characterized in that the board is made from an insulating material and comprises has a thickness in the range from 30 mm to 80 mm.

5. Wall element according to claim 1, characterized in that the extension of the first side element in the plane P amounts to ⅔ of the extension of the upper and the lower elements in the plane P, and in that the extension of the second side element in the plane P amount to ⅓ of the extension of the upper and the lower elements in the plane P.

6. Wall element according to claim 1, characterized in that a centre element extends in parallel with respect to said first and second side element and is arranged between said first and second side element, said centre element being fixed to said upper and lower element.

7. Wall element according to claim 1, characterized in that an insulating material is arranged between said first and second side element.

8. Wall element according to claim 1, characterized in that the board extends between a centre of the first and second side element on the outer side of the wall element.

9. Wall section comprising at least two wall elements according to claim 1 arranged such that the boards on the outside of the wall elements are facing the same direction and the first edge of one of the wall elements bear against the second edge of the other wall element, wherein the first side element belonging to said one of the wall elements and the second side element belonging to the other wall element bear against each other.

10. Wall section according to claim 9, characterized in that the two wall elements are joined together by joining means joining said first side element belonging to said one of the wall elements and the second side element belonging to the other wall element substantially parallel to a plane perpendicular to the outer side of the wall sections.

11. Wall section according to claim 9, characterized in that the two wall elements are joined by screwing means joining said upper and lower element belonging to said one of the wall elements and said upper and lower element belonging to the other wall element, said screwing means extending diagonally with respect to a plane perpendicular to the outer side of the wall elements.

12. Method for building said wall section {30) according to claim 9 comprising the steps of:

a) arranging said one of the wall elements in a desired location;

b) arranging the other of the wall elements such that the boards on the outer side of the wall elements are facing the same direction, and such that the first edge of said one of the wall element bears against the first edge of the other wall element, wherein the first side element belonging to said one of the wall elements and the second side element belonging to the other wall element bear against one another; and c) fastening the two wall elements to one another.

13. Method according to claim 12, wherein step c comprises fastening of the wall elements by fastening means joining said first side element belonging to said one of the wall elements and said second side element belonging to the other wall element, substantially parallel to a plane perpendicular to the outer side of the wall elements.

14. Method according to claim 12, wherein step c comprises fastening of the wall elements by screwing means joining said first side element belonging to said one of the wall elements and the second side element belonging to the other wall element, said screwing means extending diagonally with respect to a plane perpendicular to the outside of the wall elements.

* * * * *